US006807836B2

(12) United States Patent
Sambuco, Jr. et al.

(10) Patent No.: US 6,807,836 B2
(45) Date of Patent: Oct. 26, 2004

(54) METHOD OF APPLYING A SURFACE FINISH ON A METAL SUBSTRATE AND METHOD OF PREPARING WORK ROLLS FOR APPLYING THE SURFACE FINISH

(75) Inventors: Errol Sambuco, Jr., Wheeling, WV (US); Rich Hesske, Yorkville, OH (US); John McCulley, New Martinsville, WV (US); Robert Jay Ciszewski, Shadyside, OH (US)

(73) Assignee: Ormet Corporation, Wheeling, VA (US)

( * ) Notice: Subject to any disclaimer, the term of this patent is extended or adjusted under 35 U.S.C. 154(b) by 0 days.

(21) Appl. No.: 10/267,908

(22) Filed: Oct. 9, 2002

(65) Prior Publication Data

US 2003/0083000 A1 May 1, 2003

Related U.S. Application Data

(60) Provisional application No. 60/379,198, filed on May 9, 2002, and provisional application No. 60/327,932, filed on Oct. 9, 2001.

(51) Int. Cl.[7] ..... B21B 27/02

(52) U.S. Cl. ..... 72/236; 72/366.2

(58) Field of Search ..... 451/142, 49; 29/895, 29/895.1, 895.3; 72/236, 366.2, 252.5

(56) References Cited

U.S. PATENT DOCUMENTS

| | | | | | |
|---|---|---|---|---|---|
| 1,644,512 | A | * | 10/1927 | Cornelius | 451/49 |
| 3,664,066 | A | * | 5/1972 | Clark, Jr. | 451/4 |
| 3,667,270 | A | * | 6/1972 | Deurloo | 72/236 |
| 3,856,479 | A | | 12/1974 | Howle | |
| 3,891,472 | A | | 6/1975 | Yoshida et al. | |
| 3,956,915 | A | | 5/1976 | Saunders | |
| 4,377,447 | A | | 3/1983 | Bednarz | |
| 4,666,576 | A | | 5/1987 | Pliefke | |
| 4,886,713 | A | | 12/1989 | Ostermann et al. | |
| 4,978,583 | A | | 12/1990 | Wakui et al. | |
| 4,996,113 | A | | 2/1991 | Hector et al. | |
| 5,080,326 | A | | 1/1992 | Price et al. | |
| 5,156,723 | A | | 10/1992 | Pliefke et al. | |
| 5,437,746 | A | | 8/1995 | Usui et al. | |
| 5,508,119 | A | * | 4/1996 | Sheu et al. | 428/687 |
| 5,537,851 | A | * | 7/1996 | Sheu et al. | 72/366.2 |
| 5,538,600 | A | | 7/1996 | Schultz et al. | |
| 5,552,235 | A | | 9/1996 | Bastawros et al. | |
| 5,591,534 | A | | 1/1997 | Vigeant et al. | |
| 5,636,544 | A | * | 6/1997 | Tomizawa et al. | 72/366.2 |
| 5,789,066 | A | | 8/1998 | De Mare et al. | |
| 5,799,527 | A | | 9/1998 | Kenmochi et al. | |
| 5,834,129 | A | | 11/1998 | Dhillon et al. | |
| 5,986,205 | A | | 11/1999 | Matsune et al. | |
| 5,998,044 | A | | 12/1999 | Limbach et al. | |
| 6,138,490 | A | | 10/2000 | Shannon | |
| 6,153,316 | A | | 11/2000 | Shannon | |
| 6,177,206 | B1 | | 1/2001 | Sullivan et al. | |

FOREIGN PATENT DOCUMENTS

| | | | | |
|---|---|---|---|---|
| GB | 1486321 A | * | 9/1977 | B21B/3/00 |
| JP | 05317910 A | * | 12/1993 | B21B/1/22 |

* cited by examiner

*Primary Examiner*—Lowell A. Larson
(74) *Attorney, Agent, or Firm*—Webb Ziesenheim Logsdon Orkin & Hanson, P.C.

(57) ABSTRACT

The method of preparing cold mill work rolls for forming a surface finish on a metal substrate includes the steps of placing a work roll on a grinder, truing the work roll, roughening the work roll, and performing at least one finishing pass on the work roll. The method may further include the step of sanding the work roll. The finished work roll may be inserted into a cold mill and the metal substrate cold rolled with the work rolls to achieve the desired surface finish.

19 Claims, 2 Drawing Sheets

METHOD OF APPLYING A SURFACE FINISH ON A METAL SUBSTRATE AND METHOD OF PREPARING WORK ROLLS FOR APPLYING THE SURFACE FINISH

CROSS REFERENCE TO RELATED APPLICATIONS

This application claims the benefit of U.S. Provisional Patent Application Ser. No. 60/327,932, filed Oct. 9, 2001, entitled "Brush Finish Pattern For Aluminum Coil Sheet" and U.S. Provisional Patent Application Ser. No. 60/379,198, filed May 9, 2002, entitled "Brush Finish Pattern For Aluminum Coil Sheet", the disclosures of which are fully incorporated herein.

BACKGROUND OF THE INVENTION

1. Field of the Invention

The present invention relates generally to a method of applying a surface finish on a metal substrate. More particularly, the present invention relates to a method of preparing cold mill work rolls for use in applying the surface finish on a metal substrate.

2. Description of Related Art

The typical choice of material for architectural panel applications is a brushed stainless steel finished product. It is the preferred material primarily due to its shiny surface finish, thus making it popular for uses involving decorative applications, interior furniture, as well as the food industry. The use of the stainless steel brush finish look has expanded beyond architectural panel applications. Other applications include office furniture, lighting fixtures, door hardware, door kick plates, housewares, ceiling tiles, wall panels, nameplate and automotive trim applications, architectural composite applications, and the like. However, a viable alternative for stainless steel for use in such applications is aluminum. Aluminum has desirable properties that make it a beneficial alternative to stainless steel, such as being lighter, having better formability, as well as having a durable corrosion-resistant finish. Yet, one of the factors in delaying the use of aluminum instead of stainless steel in various applications is the perception that aluminum lacks the aesthetic stainless steel surface finish.

Much of the prior art in the field deals with methods of producing shiny, textured, or rough surfaces on metal. For example, U.S. Pat. No. 4,996,113 to Hector et al. is directed to a method for rolling metal material to enhance the brightness of the material. U.S. Pat. No. 5,508,119 to Sheu et al. is directed to a method of making a strip product having a specific textured surface. U.S. Pat. No. 5,789,066 to De Mare et al. is directed to a method of producing metal sheets or strips by cold reduction rolling of the metal sheet or strip with a pair of work rolls. U.S. Pat. No. 5,799,527 to Kenomochi et al. is directed to a method for producing a stainless steel sheet in which the steel sheet is cold rolled using a work roll. U.S. Pat. No. 5,998,044 to Limbach et al. is directed to an aluminum sheet that is suitable for use with the lithographic sheet support. U.S. Pat. No. 6,153,316 to Shannon is directed to mechanically textured aluminum alloy sheets that possess photometric properties. U.S. Pat. No. 6,177,206 to Sullivan et al. discloses polishing the surface of aluminum sheets for use as airplane parts. However, none of these prior art methods address how to obtain a surface finish like that of brush finish stainless steel on metal, such as non-ferrous alloys. The disclosures of the foregoing listed patents are incorporated into this disclosure by reference.

Thus, a need exists for a method of applying a surface finish on a metal substrate, such as aluminum or aluminum alloy sheet, that mimics the look of brush finish stainless steel. Additionally, a need exists for a method of preparing work rolls for applying the stainless steel finish look on a metal substrate, which has improved properties over stainless steel currently favored in the art.

SUMMARY OF THE INVENTION

The present invention is generally directed to a method of applying a surface finish on a metal substrate. More particularly, the present invention is directed to a method of applying a stainless steel look finish to a metal substrate, such as aluminum or aluminum alloy sheet. The present invention is further directed to methods of preparing cold mill work rolls for use in forming the desired surface finish on a metal substrate.

Preferably, the method of preparing the work rolls begins with placing a work roll on a grinder. The next steps include truing and roughening the work roll, and performing at least one finishing pass on the work roll. The method may include the step of comparing the surface roughness value of the work roll with a pre-designated or desired surface roughness value specification. If the surface roughness value of the work roll is not within the pre-designated or desired surface roughness value specification, the method may include the step of performing additional finishing passes. Additionally, at least two finishing passes may be performed. The method may also include the step of inspecting the work roll for defects and uniformity. The finished work roll may have a surface roughness value of between about 62–79 microinches Ra. The method of preparing cold mill work rolls, in another embodiment of the present invention, may further include the step of sanding the work roll. The finished work roll in this embodiment may have a surface roughness value of between about 40–45 microinches Ra.

The metal substrate may be aluminum or an aluminum alloy sheet. The metal substrate may have a gauge thickness of between about 0.004"–0.125" and a width of between about 1"–69" and, preferably, between about 15"–60". The surface finish preferably has a stainless steel brush surface appearance.

The present invention is also a method of applying a surface finish on a metal substrate and generally begins with placing a work roll on a grinder. The work roll then undergoes truing and roughening. At least one finishing pass is performed on the work roll to obtain a desired surface roughness. The work roll is then inserted into a cold mill, and the metal substrate is then cold rolled with the work roll to achieve the desired surface finish of the metal substrate.

The method may further include the step of sanding the work roll. The metal substrate may have a gauge thickness of between about 0.004"–0.125". Additionally, the metal substrate may have a gauge thickness of between about 0.005"–0.063". The applied surface finish preferably has a brushed stainless steel surface appearance. The surface finish of the metal substrate has a surface roughness value of between about 60–95 microinches Ra. Additionally, a cold rolled metal sheet, including a cold rolled aluminum or aluminum alloy sheet, may be made utilizing this method.

Further details and advantages of the present invention will become apparent from the following detailed description when read in conjunction with the drawings.

DESCRIPTION OF THE PREFERRED EMBODIMENTS

Figure 1:
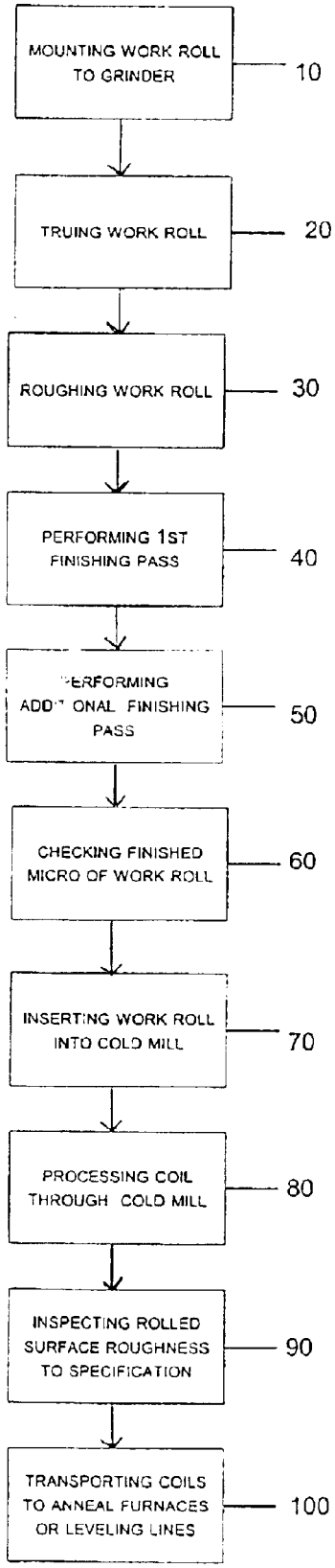
FIG. 1 is a flow chart of a method of preparing cold mill work rolls and applying a desired surface finish on a metal substrate in accordance with the present invention.

FIG. 1 is a flow chart generally showing the method steps to be followed in preparing cold mill work rolls utilized in applying a desired surface finish on a metal substrate in accordance with the present invention. The cold mill work rolls may be utilized in various cold mill configurations, such as a single stand or multi-stand mill. However, at present, a single stand cold mill is preferred. Additionally, the surface finish achieved by using the cold mill work rolls prepared by the method generally shown in FIG. 1 provides a short brush finish with continuous scratch characteristics as the surface finish of the metal substrate. The process begins initially with the unloading of cold mill work rolls from a roll table. The chocks from both top and bottom work rolls are swung and put on a following set of good work rolls. The work rolls are then transported and mounted at step 10 to a grinder, preferably a 24" grinder. The work roll to be finished is aligned and centered on the grinder.

After placing the work roll on the grinder, the work roll is trued at step 20. Truing of the work roll at step 20 ensures that the work roll is not out of roundness as a result of previous rolling operations. Failing to true the work roll may cause complications during cold reduction as well as in the finished product, such as a lack of uniformity in the surface finish. The work roll is then measured to check and obtain a start size so that head stock removal may be monitored in the following steps. Head stock removal generally entails removing a specific amount of material from the surface of the work roll, preferably just enough to remove damage from previous rolling operators. By measuring the work roll initially and then periodically throughout the process, the amount of head stock removal may be ascertained. The amount of normal stock removal is monitored to ensure consistency in the preparation of the work roll for the following finishing steps. The removal of head stock begins with the work roll rotating and turning with the wheel approach and start carriage settings on the grinder set to maximum speed. The carriage is traversed to the tail stock and the tail stock bearing is adjusted to attain the same amperage as the head stock reading, as would be known by one skilled in the art.

Roughening the work roll at step 30 occurs after truing the work roll at step 20. The step of roughening of the work roll at step 30 is performed to remove any residuary roll grinder patterns from previous uses. Residuary work roll grinder patterns can distort preparation of the work rolls if not removed, which may affect the surface finish of the final product. The roughening step 30 is performed, for example, with a 120 grit grinder wheel and with the grinder wheel feed selector set to "manual". The grinder wheel feeder selector set to "manual" indicates that an operator maintains control of grinding the work roll. The grinder is commonly run in "manual", with the operator allowing the unit to run and traverse across the work roll. When the operator sets the grinder to "amps", as will be described hereinbelow, the operator targets a specific amperage range thus requiring him or her having to monitor the grinder to ensure that the target amperage range is met. The following parameters may be utilized during roughening of the work roll at step 30: a roll speed of approximately 35 rpm, a wheel speed of approximately 400–450 rpm, a traverse speed of approximately 52 IPM, and an in-feed amount of approximately 0.002"–0.004". The work rolls are ground at roughening step 30 until the same amperage from end to end (true roll) is achieved and a minimum stock of approximately 0.002"–0.005", preferably 0.005", is removed. Therefore, during roughening of the work roll at step 30, the work roll will be measured at intervals, such as after the conclusion of each pass, to determine stock removal, with an aim of 0.002"–0.005" stock removal.

A first finishing pass at step 40 on the work roll utilizes a grinding wheel, for example, a Sterling manufactured C-36 type grinding wheel with a GC-36-1-J6-blw wheel specification or similar device known in the art. The C-36 type grinding wheel is utilized throughout the following steps. The first finishing pass at step 40 provides the work roll with a scratch pattern, such as one that mimics a stainless steel brush pattern. In this step, the grinding wheel feed selector is preferably set to "amps", so that the grinder operator may set the grinder to target a desired amperage or amperage range. The wheel and hose down wheel and coolant trough of the grinder are then cleaned. These items are cleaned at the conclusion of each roughening pass to ensure the integrity of the work roll preparation. Furthermore, upon completion of preparation of the work roll or completion of finishing passes at step 40, the operator may proceed to clean the grinder area which may include the changing of filter paper in the grinder between passes. The following settings, for example, may be used for the first finishing pass 40: a roll speed of approximately 100 rpm, a wheel speed of approximately 50 rpm, a traverse speed of approximately 52 IPM, and a carry of approximately 35–40 amps. A carry of approximately 35–40 amps indicates that the operator monitors the grinder settings such that the amperage range is maintained during that particular step. During the first finishing pass at step 40, the finishing pass is completed in preferably one direction.

Additional finishing passes at step 50 may be required during the preparation of the work roll. The final finishing pass or passes at step 50 are conducted with the intent of removing burrs and grit roll from the work roll surface without affecting the final surface roughness. In addition, the final finishing pass or passes at step 50 provide for uniformity of the final surface. The settings utilized for the additional finishing pass or passes at step 50 preferably are: a roll speed of approximately 100 rpm, a wheel speed of approximately 200 rpm, a traverse speed of approximately 52 IPM, and a carry of approximately 2 amps. The number of finishing passes may vary due to the material as well as operating conditions. Particular modifications to the above-described grinding procedure may be necessary due to the variability of operating conditions, such as machine, abrasive, roll, etc. One such example would include the use of a new grinding wheel. A new grinding wheel compared to a repetitively used grinding wheel would not utilize the same amperage settings to achieve the same finish. For example, an older grinding wheel would decrease in size with repeated numerous uses. Thus, the amperage setting for the older grinding wheel may need to be increased to achieve the same finish that a new grinding wheel would provide at lower amperage. Another example would include the condition of the work roll. If the work roll has not previously been prepared for cold working, the initial preparation of roughening and finishing passes may require additional passes or higher settings, such as amperage, to achieve the same results with the settings indicated previously.

The number of finishing passes may vary so as to bring the average surface roughness values (Ra) to approximately 73–79 microinches Ra, preferably 76 microinches Ra for a gauge thickness greater than 0.025" and approximately 62–72 microinches Ra, preferably 68 microinches Ra, for a gauge thickness less than 0.025". The surface roughness value is measured with a perthometer and the surface roughness values are typically obtained over an average of 20 readings. The metal substrate upon which the work rolls will apply a desired surface finish may be a metal sheet, ingot, bar, foil and the like.

The number of finishing passes may vary so as to achieve a desired surface roughness value on the work roll, which in turn corresponds to achieving a desired surface roughness value on the final product. For example, for gauge thickness greater than 0.025", work roll surface roughness values of approximately 73–79 microinches Ra, approximately 420–550 Rz, and approximately 550–700 Rmax is desired. By obtaining work rolls with the above surface roughness values, in combination with the cold rolling process, a surface finish on a metal substrate having a surface roughness value range of approximately 85–95 microinches Ra, 420–550 Rz, and approximately 530–700 Rmax, may be achieved. Similarly for gauge thickness less than 0.025", desired surface roughness values for the work roll include approximately 62–73 microinches Ra, approximately 360–550 Rz, and approximately 430–570 Rmax. These work roll surface roughness values allow for a surface finish on a metal substrate having a surface roughness range of approximately 60–80 microinches Ra. The surface roughness values of the surface finish on the metal substrate may be obtained by measuring the top and bottom surface of the metal substrate, such as a sheet. For example, five readings may be taken from the top surface of the sheet and averaged and two readings on the bottom surface of the sheet can be taken and averaged to determine the surface roughness value of the finished product.

The finished surface of the work roll is inspected or checked at step 60 upon completion of additional finishing passes at step 50 on the work roll. Inspection of the work roll at step 60 includes the comparison of the final work roll surface with that of the desired or pre-designated surface roughness value specification. The surface roughness value of the work roll may be compared to a pre-designated surface value specification. If the surface roughness value of the work roll is not within the pre-designated surface roughness value specification, additional finishing passes may be performed to bring the work roll into conformance. The inspection of the work roll at step 60 may further include a visual inspection in addition to measuring the surface roughness value with a perthometer. Furthermore, the operator may skate the roll as part of the inspection. When the operator skates the roll, he or she is checking the shape of the roll to ensure that it is uniform and in conformance with the specification. The work roll is now prepared to be utilized in the cold rolling operations to apply the surface finish, as will be discussed hereinafter.

Figure 2:
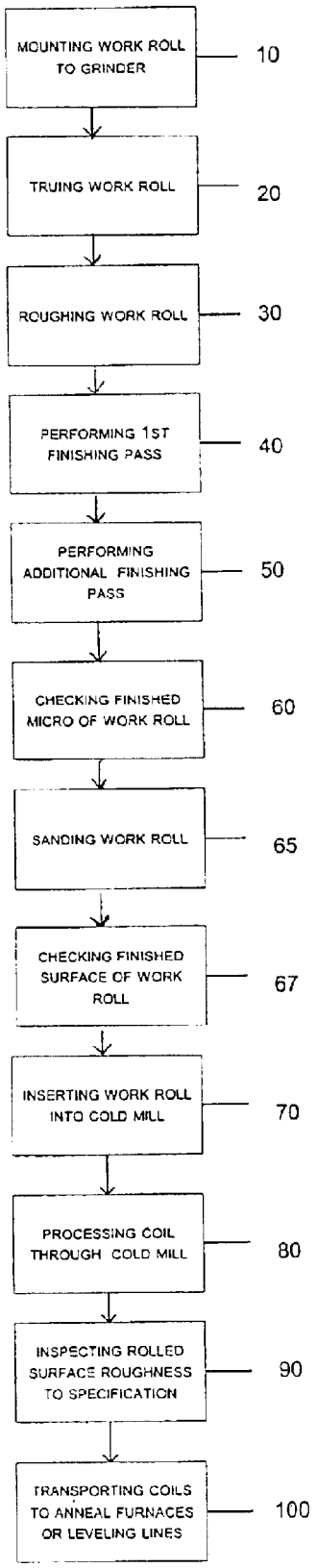
FIG. 2 is a flow chart of a second embodiment of the method of preparing cold mill work rolls and applying a desired surface finish on a metal substrate in accordance with the present invention.

FIG. 2 illustrates another method according to the present invention for preparing work rolls used to apply a desired surface finish pattern, such as a long line brush finish. First, the work roll is mounted on the grinder at step 10. Next, the truing step 20 and the roughening step 30 are performed on the work roll in a similar manner as described previously. Roughening of the work roll at step 30 utilizes, for example, a 280 grit grinder wheel, and includes moving the wheel along the work roll on each pass, so as to provide uniform roughening. The following parameters may be utilized in roughening step 30 in this embodiment: a carriage speed of approximately 25–35 rpm, a wheel speed of approximately 450–500 rpm, and head stock of approximately 52 IPM. The work roll is ground at roughening step 30 until the same amperage from end to end is achieved with the removal of minimum stock, approximately 0.002"–0.005", preferably 0.005".

A number of finishing passes may be performed at steps 40 and 50. Preferably three finishing passes are performed on the work roll. During the first finishing pass utilizing a 280 grit wheel, the following settings, for example, may be utilized: a roll speed of approximately 35 rpm, a wheel speed of approximately 400 rpm, a table speed of approximately 45 IPM, and a feed to carry setting of approximately 7 amps, wherein the operator is monitoring the grinder to maintain the amperage at 7 amps. During the second finishing pass, the following settings may be used: a roll speed of approximately 40 rpm, a wheel speed of approximately 300 rpm, and a traverse speed of approximately 26 IPM. The final finishing pass is made with a lower table speed and wheel speed settings, preferably approximately 6–12 IPM, and approximately 200–375 rpm, respectively, a higher roll speed of approximately 45 rpm, and a lower feed to carry amperage of approximately 0.5–1.0 amps. The work roll is then checked at step 60 with a perthometer for the surface roughness attribute or value of approximately 10–12 microinches Ra.

The work roll is then moved to the polisher upon completion of roughening the work roll and confirming compliance with desired specifications at step 60. Checking the finished work roll at step 60 may be performed in a similar manner as described previously. The final step to achieving the desired surface roughness value on the work roll is to proceed with sanding the work roll at step 65. The step of sanding 65 allows for the ability to achieve the desired long, non-continuous scratch characteristic pattern. For example, the sanding step 65 may be performed with the use of 80 grit paper at approximately 100 paper speed at "lathe" settings for carriage and roll speeds. Additional passes may be performed if the surface roughness value specification is not within the desired range. The surface roughness value utilizing a perthometer is checked again if additional passes are performed for conformance to the pre-designated or desired surface roughness value specification. Checking the work roll at step 60 includes a surface roughness value check as well as a visual inspection to assure the uniformity of the work roll as well, and confirm the lack of defects. For example, the desired range may be approximately 40–45 microinches Ra, which is typically obtained over an average of 20 readings. In this embodiment of the present invention, the surface roughness value of the work roll corresponds to the surface roughness value of the surface finish of the metal substrate, such as a finished sheet product. Inspection of the work roll at step 60 includes the comparison of the final work roll surface with that of the desired or pre-designated specification. The surface roughness value of the work roll is compared to a pre-designated surface value specification. If the surface roughness value of the work roll is not within the pre-designated surface roughness value specification, additional finishing passes may be performed to bring the work roll into conformance. The inspection of work roll at step 60 may further include a visual inspection.

Upon confirmation of meeting the desired surface roughness specification value, the work rolls prepared by either of the methods described hereinabove is ready for cold rolling. A roll change is conducted by inserting the surface-roughened work rolls into the cold mill at step 70. Coil is then processed through the mill at step 80 utilizing the work rolls. The metal substrate is preferably aluminum or aluminum alloy sheet and the finished product preferably has a stainless steel brush finish surface appearance. Quality samples may be taken at specific intervals to ensure conformance to all work roll surface roughness specifications and surface quality requirements at step 90. The completed surface finished coil (i.e., sheet) may then be transported to either anneal furnaces or leveling lines and the like at step 100, depending on the intended application and customer requirements. Additionally, the surface finished coil (i.e., sheet) may undergo further surface finishing treatments, such as anodizing. For example, aluminum or aluminum alloy sheet with the desired stainless steel look-alike brush surface finish may be provided in different colors by the process of anodizing. The use of aluminum thus provides desirable weight saving advantages over stainless steel as well as the ability to provide metal sheet in different colors.

The processes described hereinabove may be applied to most metals, but preferably applied to aluminum and aluminum alloys. The preferred alloys for this disclosure are 1000, 3000, 5000, and 6000 alloy families within the Aluminum Association Register in addition to 8000 series alloys. The final product, as indicated previously, may be utilized for various applications in addition to replacing architectural panels, such as food service products, medical and electrical cabinetry, and electronic cosmetic products. Other applications include office furniture, lighting fixtures, door hardware, door kick plates, housewares, ceiling tiles, wall panels, nameplate and automotive trim applications, as well as architectural composite applications.

It will be understood that while the foregoing description describes preferred embodiments of the present invention, modifications, additions, and alterations may be made by those skilled in the art without departing from the spirit and scope of the invention. The foregoing detailed description is intended to be illustrative rather than restrictive. The scope of the present invention is defined in the appended claims and all equivalents thereto.

What is claimed is:

1. A method of preparing cold mill work rolls for use in applying a brush surface finish on a metal substrate, comprising the steps of:

placing a work roll on a grinder;

truing the work roll;

roughening the work roll; and performing at least one finishing pass to provide a scratch pattern that mimics a stainless steel brush pattern on the work roll.

2. The method as claimed in claim 1, wherein the finished work roll has a surface roughness value of between about 62–79 microinches Ra.

3. The method as claimed in claim 1, comprising at least two finishing passes, wherein a first of said finishing passes provides the work roll with said scratch pattern and a second of said finishing passes removes burrs and grit from the work roll surface.

4. The method as claimed in claim 1, further comprising the steps of comparing surface roughness value of the work roll with a pre-designated surface roughness value specification.

5. The method as claimed in claim 4, further comprising the step of performing additional finishing passes if the surface roughness value of the work roll is not within the pre-designated surface roughness value specification.

6. The method as claimed in claim 1, further comprising the step of inspecting the work roll for defects and uniformity.

7. A method of preparing cold mill work rolls for use in forming a surface finish mimicking a stainless steel brush surface on a metal substrate, comprising the steps of:

placing a work roll on a grinder;

truing the work roll;

roughening the work roll;

performing at least one finishing pass to provide a scratch pattern that mimics a stainless steel brush pattern on the work roll; and sanding the work roll.

8. The method as claimed in claim 7, wherein the work roll has a surface roughness value of between about 40–45 microinches Ra.

9. The method as claimed in claim 7, comprising at least two finishing passes.

10. The method as claimed in claim 7, further comprising the step of comparing a surface roughness value of the work roll with a pre-designated surface roughness value specification.

11. A method of forming a stainless steel brush surface finish on an aluminum substrate, comprising the steps of:

placing a work roll on a grinder;

truing the work roll;

roughening the work roll;

performing at least one finishing pass to provide a scratch pattern that mimics a stainless steel brush pattern on the work roll;

inserting the work roll in a cold mill; and cold rolling the metal aluminum substrate with the work roll to achieve the brush surface finish of the aluminum substrate.

12. The method as claimed in claim 11, wherein the aluminum substrate has a gauge thickness of between about 0.004"–0.125".

13. The method as claimed in claim 11, wherein the aluminum substrate has a gauge thickness of between about 0.005"–0.063".

14. The method as claimed in claim 11, wherein the brush surface finish of the aluminum substrate has a surface roughness value of between about 60–95 microinches Ra.

15. The method as claimed in claim 11, wherein the aluminum substrate is aluminum or an aluminum alloy sheet.

16. The method as claimed in claim 11, further comprising the step of sanding the work roll.

17. A method of applying a brush surface finish to aluminum alloy strip comprising:

(a) providing at least one work roll of a cold mill by the steps of:

(1) placing the work roll in a grinder;

(2) truing the work roll;

(3) roughening the work roll; and (4) performing at least one finishing pass to provide a scratch pattern that mimics a stainless steel brush pattern on the work roll;

(b) providing an aluminum alloy strip; and (c) cold rolling said aluminum alloy strip while contacting said strip with the work roll provided in step (a) to impart at least one cold rolled surface on said aluminum alloy strip having the appearance of a brush finish.

18. The method of claim 17 including the step of coiling the cold rolled aluminum alloy strip having the brush surface applied thereon.

19. The method of claim 18 wherein two opposed work rolls of the cold mill are provided according to step (a) to impart a brush finish on opposed sides of said aluminum alloy strip.

* * * * *

UNITED STATES PATENT AND TRADEMARK OFFICE

CERTIFICATE OF CORRECTION

PATENT NO. : 6,807,836 B2
DATED : October 26, 2004
INVENTOR(S) : Sambuco, Jr. et al.

It is certified that error appears in the above-identified patent and that said Letters Patent is hereby corrected as shown below:

Column 8,
Line 28, "metal aluminum substrate" should read -- aluminum substrate --

Signed and Sealed this

Seventeenth Day of May, 2005

JON W. DUDAS
*Director of the United States Patent and Trademark Office*